US008789324B2

(12) United States Patent
Hay et al.

(10) Patent No.: US 8,789,324 B2
(45) Date of Patent: Jul. 29, 2014

(54) IMPACT RESISTANT WINDOW

(76) Inventors: Henry M. Hay, Charleston, SC (US); Bruce Weber, Summerville, SC (US); Craig B. Duncan, Port Richey, FL (US)

( * ) Notice: Subject to any disclaimer, the term of this patent is extended or adjusted under 35 U.S.C. 154(b) by 0 days.

(21) Appl. No.: 12/694,467

(22) Filed: Jan. 27, 2010

(65) Prior Publication Data

US 2010/0186641 A1 Jul. 29, 2010

Related U.S. Application Data

(63) Continuation-in-part of application No. 12/070,687, filed on Feb. 20, 2008, and a continuation-in-part of application No. 12/077,113, filed on Mar. 17, 2008, now abandoned, and a continuation-in-part of application No. 11/705,979, filed on Feb. 13, 2007, now abandoned, and a continuation-in-part of application No. 12/217,425, filed on Jul. 3, 2008, now abandoned.

(51) Int. Cl.
*E06B 3/26* (2006.01)
*E06B 3/964* (2006.01)

(52) U.S. Cl.
USPC ..... 52/204.69; 52/202; 52/204.62

(58) Field of Classification Search
USPC ..... 52/788.1, 202, 786.1, 786.13, 204.62, 52/204.69; 428/34; 156/109
See application file for complete search history.

(56) References Cited

U.S. PATENT DOCUMENTS 2,756,467 A 11/1952 Etling
3,128,509 A 4/1964 Stotz
3,212,179 A 10/1965 Koblensky
3,620,905 A 11/1971 Abramjian
3,764,457 A 10/1973 Chang
3,823,060 A 7/1974 McClung et al.
3,931,113 A 1/1976 Seeger et al.
3,932,971 A 1/1976 Day
4,999,147 A * 3/1991 Kojima et al. ..... 264/139
5,544,457 A * 8/1996 Labrecque ..... 52/204.69
5,560,149 A * 10/1996 Lafevre ..... 49/501
5,636,484 A * 6/1997 DeBlock ..... 52/204.5
5,992,107 A * 11/1999 Poirier ..... 52/203
6,237,306 B1 * 5/2001 Dlubak ..... 52/786.11
6,286,288 B1 9/2001 France
6,546,692 B1 4/2003 Duncan et al.
6,563,182 B2 5/2003 Horikawa
6,662,523 B2 12/2003 Hornung et al.
6,679,013 B2 1/2004 Hornung
6,823,643 B2 11/2004 France
6,889,480 B2 * 5/2005 Guhl et al. ..... 52/786.1
6,912,817 B1 * 7/2005 Sabac et al. ..... 52/204.54
6,928,776 B2 * 8/2005 Hornung ..... 52/204.62
6,931,799 B2 * 8/2005 Webb ..... 52/167.1
6,974,518 B2 12/2005 Hornung et al.

(Continued)

*Primary Examiner* — Ryan Kwiecinski

(74) *Attorney, Agent, or Firm* — B. Craig Killough; Barnwell, Whaley, Patterson, Helms

(57) ABSTRACT

A novel impact and blast resistant window is presented. A surface of a window pane that is adjacent to an interior of a building has a durable transparent polymer film coated or adhered thereto. The surface of a window pane that is adjacent to an interior of a building is sealed to the sash by double sided tape. The resulting window produces an unexpected ability for the durable transparent polymer film to retain pieces of broken glass driven toward the interior of the building by a missile striking an exterior of the window, without the durable transparent polymer film pulling loose from the window sash.

23 Claims, 3 Drawing Sheets

(56) References Cited

U.S. PATENT DOCUMENTS

| | | | | |
|---|---|---|---|---|
| 7,204,901 | B2 | 4/2007 | Bayha et al. | |
| 7,555,871 | B1 * | 7/2009 | Neal | 52/204.51 |
| 7,815,997 | B2 * | 10/2010 | Reuter | 428/212 |
| 7,845,124 | B1 * | 12/2010 | Neal | 52/204.1 |
| 7,958,682 | B2 * | 6/2011 | Elzein | 52/204.53 |
| 2003/0200718 | A1 * | 10/2003 | Ito | 52/716.5 |
| 2004/0020143 | A1 * | 2/2004 | Webb | 52/204.53 |
| 2005/0126091 | A1 | 6/2005 | Sherrett et al. | |
| 2005/0132662 | A1 | 6/2005 | Hornung et al. | |
| 2006/0093810 | A1 * | 5/2006 | Blake et al. | 428/343 |
| 2006/0218875 | A1 | 10/2006 | Hornung et al. | |
| 2008/0063819 | A1 * | 3/2008 | Monroe et al. | 428/34 |
| 2008/0134597 | A1 * | 6/2008 | Rinehart et al. | 52/204.62 |
| 2008/0190070 | A1 * | 8/2008 | Duncan et al. | 52/786.11 |
| 2008/0196317 | A1 * | 8/2008 | Duncan et al. | 49/506 |
| 2008/0292834 | A1 * | 11/2008 | Haldeman | 428/98 |
| 2009/0056246 | A1 * | 3/2009 | Prince et al. | 52/204.53 |
| 2009/0229216 | A1 * | 9/2009 | Duncan et al. | 52/745.2 |

* cited by examiner

IMPACT RESISTANT WINDOW

This application is a continuation-in-part and claims priority of pending application Ser. No. 12/070,687, filed Feb. 20, 2008 and is a continuation-in-part and claims priority of pending application Ser. No. 12/077,113, filed Mar. 17, 2008, and is a continuation-in-part of and claims priority of pending application Ser. No. 11/705,979, filed Aug. 15, 2008, and is a continuation-in-part and claims priority of pending application Ser. No. 12/217,425 filed Jul. 3, 2008.

FIELD OF THE INVENTION

The present invention relates to windows, and more particularly to windows that are impact resistant.

BACKGROUND OF THE INVENTION

Windows and glass panes in doors, panels and the like are a major source of unwanted heat loss and gain in a structure. With increased cost of fuel and energy, the moderation of unwanted energy losses on account of these structures has become of increasing importance.

One method of reducing heat transfer through windows has been through the use of double glazed, and even triple glazed windows. Double glazed windows make use of two panes of glass that are attached together by a spacer. In some instances, the space between the two panes is hermetically sealed and can be filled with dry air, or with a dry inert gas such as argon or nitrogen.

Although double glazing successfully reduces the energy transfer through a window, the use of two panes of glass substantially increases the weight of the window. Increased weight in windows is normally unwanted because of the need for heavier frames and sashes, heavier mounting hardware, and more rigid sash materials. Moreover, construction of double glazed windows is more complex than normal window construction, because the double glazed pane unit is constructed separately from the sash unit and then the sealed double glazed pane unit is mounted into the sash to assemble the insulated window.

An alternative to the normal method of assembling a double glazed window makes use of a sash unit that has the spacer for the glazing panes formed integrally with the sash. This innovation avoids the separate construction of the sealed double glazed pane unit, because the panes are mounted into a sash that has been formed from sash elements that include the integral spacer.

During the past several years, it has also become important to provide windows that are impact resistant. Many building codes, especially in areas that are at risk for hurricanes and major storms, now require impact resistant windows. In addition, blast resistance and shatter resistance has come to be important for windows in selected locations. A conventional method for the provision of impact and shatter resistance for windows has been the construction of safety glass. In this method of construction, a layer of durable transparent material, which may be a polymer, such as a polyurethane or polyvinyl butyral (PVB), is inserted between and adhered to two panes of glass to make a layered structure having glass on the outside and the polymer on the inside. Uvekol® may be used as the durable transparent material. When the window absorbs a blow that is powerful enough to break the glass, the presence of the durable polymer inhibits pieces of glass from flying in the direction of travel of the blow.

However, in many cases, the pane of glass separates from the sash. As the pane of glass is shattered by a missile, it tends to separate from the sash. The now shattered pane of glass separates from the sashes and enters the structure in the direction of travel of the missile, creating a hazard. There is a need to reduce the tendency of the pane of glass to separate from the sash, and also to reduce the tendency of the pieces of shattered glass from separating.

SUMMARY OF THE INVENTION

The present invention is directed to a novel multiple glazed impact resistant window and a method of making the multiple glazed impact and blast resistant window. The method includes forming a window sash that delineates a mounting space for mounting a first pane and a second pane opposite and parallel to and spaced apart from each other. A durable transparent or translucent polymer film 10 is attached to a surface of a pane 12 that is adjacent to the interior of the structure. The film inhibits pieces or shards of glass from entering the structure if the glass is broken by an impact or a blast. Double sided tape 14 adheres the film to a sash 16 so that the film is inhibited from pulling away from the window sash. The resulting window will pass applicable missile tests. The resulting window also provides additional security protection for the building in which it is installed, and for the building's inhabitants.

DETAILED DESCRIPTION OF THE PREFERRED EMBODIMENTS

Figure 2:
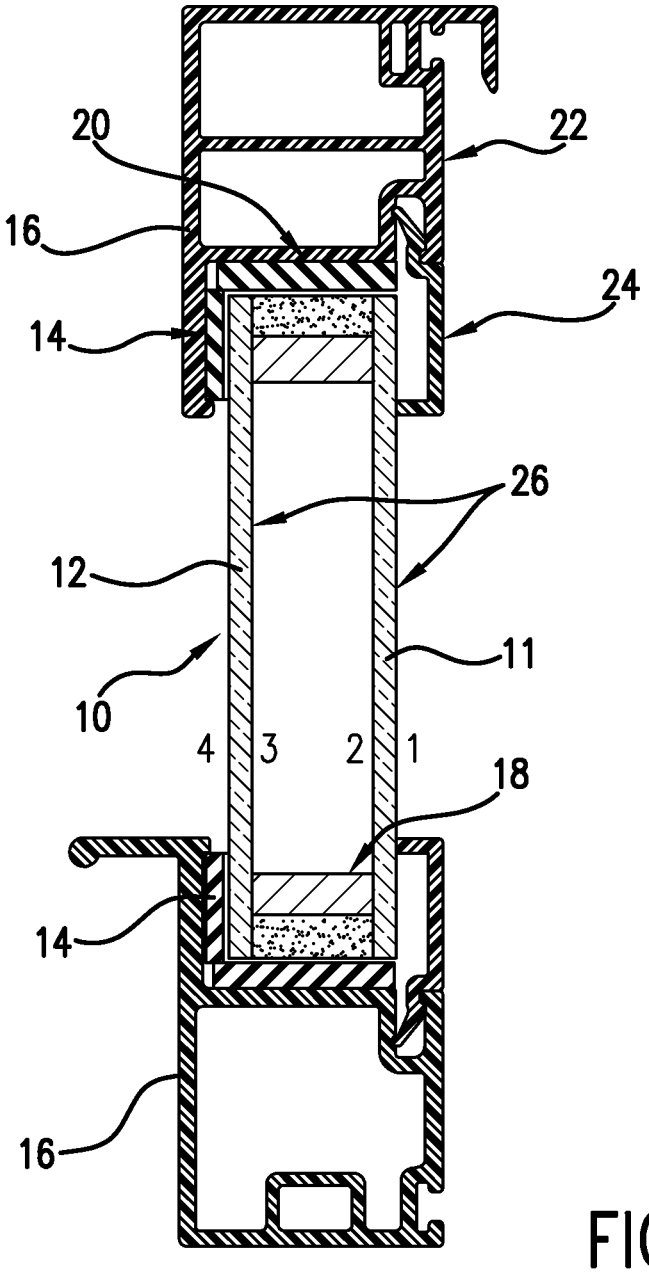
FIG. 2 shows a cross-section of an embodiment of a double glazed glass pane window with a protective layer of durable transparent or translucent polymer film on in accordance with the present invention, wherein the interior pane is fixed to the sash 16 with double sided tape that contacts a durable polymer film attached to the pane.

In one embodiment of the present invention, a double glazed impact resistant window is produced by forming a window sash that delineates a mounting space for mounting a first pane and a second pane opposite and parallel to and spaced apart from each other. FIG. 2. One pane of the window is provided with a durable translucent or transparent polymer film on what is designated as surface four (4) of the glazing. The film can be formed by coating or adhering the durable transparent polymer film to surface four (4) of the pane. The film can be applied to the pane either before or after it is conformed to the size required for the mounting space. The first pane is mounted in the mounting space, and the second pane is mounted in the mounting space to form a double glazed impact resistant window. Double sided tape adheres the pane comprising surface 4 to the sash.

In use, if a missile or similar object impacts the window, the glazing of the first pane 11 and the second pane 12 may be broken. The polymer film 10, by being present on surface 4, acts as a "net" or barrier between the glazing and the interior of the building to inhibit debris from entering the building. The polymer film retains the shards and pieces of broken glazing material caused by missile impact. However, empirical observation teaches that the polymer film will pull away from the sash due to the energy applied to the polymer film from impact of the missile or similar object. Unexpectedly, the use of double sided tape 14, with one side of the adhesive tape attached to surface 4 and the opposite side of the adhesive tape attached directly adjacent the sash as show in FIG. 2, materially retards the polymer film from pulling away from the sash, so that the polymer film retains the broken glazing and prevents broken glazing from entering the structure. The resulting window will pass current impact resistance testing for windows according to applicable building codes for ASTM E1886, ASTM E1996, and Wind Zone 3, small missile and large missile.

The double sided tape 14 is adhered to the durable transparent film, which is adhered to the portions of surface 4 of the second pane that are in close proximity of the sash. FIG. 2. As shown in the drawing figure, the double sided tape is positioned within and relative to the sash so that it is not visible to the casual observer of the window.

Figure 3:
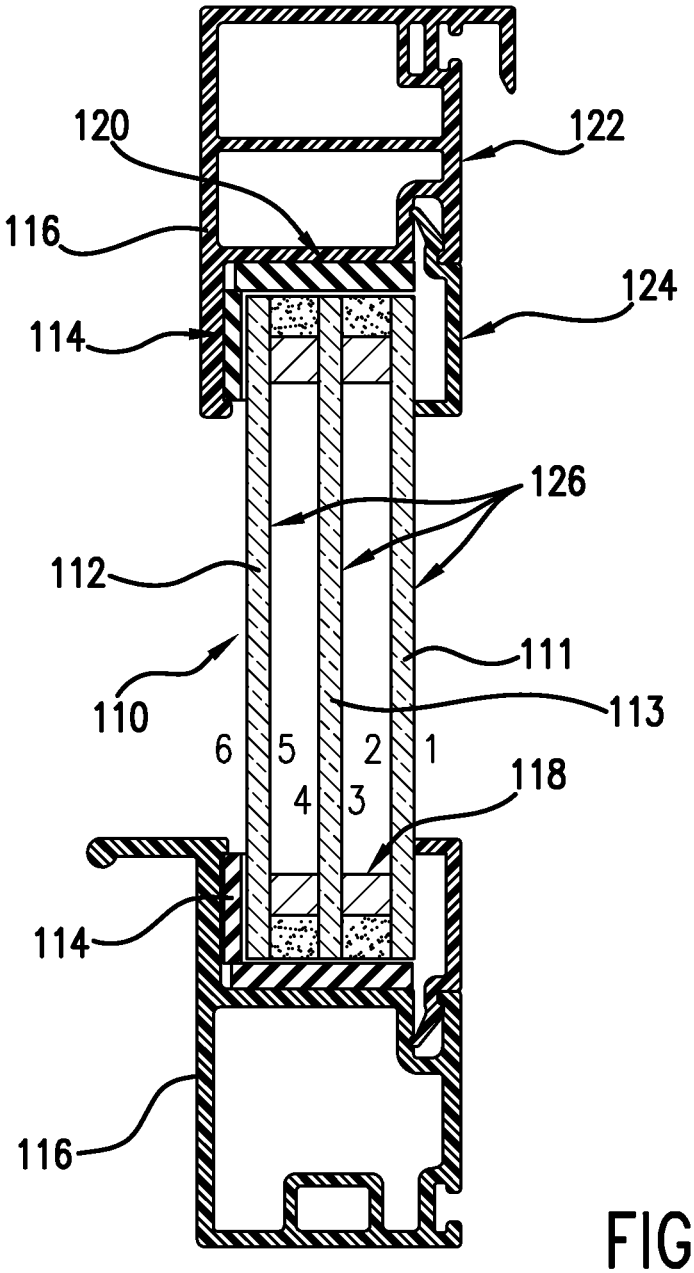
FIG. 3 shows a cross-section of an embodiment of a triple glazed glass pane with a protective layer of durable transparent or translucent polymer film on in accordance with the present invention, wherein the interior pane is fixed to the sash 116 with double sided tape that contacts a durable polymer film attached to the pane.

FIG. 3 shows a triple glazed window. If a missile or similar object impacts the window, the glazing of the first pane 111 the second pane 113 and the third pane 112 may be broken. The polymer film 110, by being present on surface 6, acts as a "net" or barrier between the glazing and the interior of the building to inhibit debris from entering the building. The polymer film retains the shards and pieces of broken glazing material caused by missile impact. However, empirical observation teaches that the polymer film will pull away from the sash due to the energy applied to the polymer film from impact of the missile or similar object. Unexpectedly, the use of double sided tape 114, with one side of the adhesive tape attached to surface 6 and the opposite side of the adhesive tape attached directly adjacent the sash as show in FIG. 3, materially retards the polymer film from pulling away from the sash, so that the polymer film retains the broken glazing and prevents broken glazing from entering the structure.

Double sided tape 114 is adhered to the durable transparent film, which is adhered to the portions of surface 6 of the interior pane that are in close proximity of the sash. FIG. 3. As shown in the drawing figure, the double sided tape is positioned within and relative to the sash so that it is not visible to the casual observer of the window.

As used herein, the terms "directly adjacent the sash" means the side of the pane is abutting an inner edge of the sash, wherein the outer edge of the sash directly opposite the inner edge will form either the front or back side of the window sash.

In an embodiment of the invention, the sash can be formed from extruded PVC members. The parts of the sash, commonly the top and bottom rails and the left and right stiles, can then be cut and assembled from the PVC extrusion to form one or more mounting spaces for panes. The sash may optionally include a spacer 18, providing mounting surfaces for the panes. Surface 4 can be coated with the durable transparent polymer film anytime prior to assembly, and assembly can be completed by attaching double-sided glazing tape to the mounting surfaces and sealing the panes to the glazing tape. Snap-in glazing beads can be installed if desirable.

When a polymer extrusion is used for the sash construction, the resulting window requires very little maintenance and is very resistant to environmental damage.

As used herein, the term "window" means a sash with one or more transparent or translucent glazing panes that can be used to cover any opening in a structure. Commonly, a window is installed in a window frame. The term window includes all windows, such as single hung windows, double-hung windows, bay windows, bow windows, casement windows, fixed windows, and the like; door panels having transparent or translucent glazing; wall panels having transparent or translucent glazing; and similar structures.

As used herein, the term "sash" means the framework that holds the glazing in a window.

As used herein, the terms "mounting space" mean the space in a sash into which a glazing pane is to be mounted. Commonly the mounting space is delineated by the parts, or elements, of the sash, which are cut to the proper size that when attached together form a mounting space of approximately the same shape and slightly larger size than the glazing pane that is to be mounted therein. The mounting space can be of any shape and size, including round, oval, oblong, rectangular, square, triangular, pie-shaped, or of any other shape. Commonly, the mounting space is square, rectangular, or round.

As used herein, the terms "sealing surface" mean a surface, such as a surface of a spacer or a surface of a sash against which the glazing pane is mounted. The sealing surface is commonly a flat surface that is parallel to the plane of the glazing pane.

As used herein for double glazed windows, the first pane 11 is the pane closest to the exterior of the building in which the window is mounted, and the second pane 12 is the pane closest to the interior of the building in which the window is mounted. Surfaces 1, 2, 3 and 4 of the first and second panes, respectively, are as shown in FIG. 2. Surface 1 is on the first pane and is adjacent to the exterior of the building in which the window is mounted, and surface 2 is present on the first pane on an interior of the window adjacent to the spacing between panes. Surface 3 is present on the second pane and is adjacent to the spacing between panes. Surface 4 is present on the second pane and is adjacent to the interior of the building in which the window is located.

As used herein for triple glazed windows, the first pane 111 is the pane closest to the exterior of the building in which the window is mounted, and the third pane 112 is the pane closest to the interior of the building in which the window is mounted. Surfaces 1, 2, 3, 4, 5 and 6 of the first, second and third panes, respectively, are as shown in FIG. 3. Surface 1 is on the first pane and is adjacent to the exterior of the building in which the window is mounted, and surface 2 is present on the first pane on an interior of the window adjacent to the spacing between panes. Surfaces 3 and 4 are present on the second pane and adjacent to the spacing between panes. Surfaces 5 and 6 are present on the third pane, and Surface 6 is adjacent to the interior of the building in which the window is located.

In some embodiments, the present sash may be free of an integral spacer.

As shown in FIG. 2, the first pane and the second pane of the double glazed window are spaced apart by a distance that is determined by the width of the sash or, where present, the spacer 18. The glazing panes comprise a first glazing pane 11 and a second glazing pane 12, the second glazing pane having a durable transparent polymer film 10 attached to surface 4. Double sided tape 14 is used to further seal the second glazing pane to the sash. The first pane and the second pane may be attached to the sealing surfaces of the spacer by one or more additional sealants.

The window may comprise a setting 20 block, a sash frame 22, a glazing stop 24, and panes formed of glass 26.

As shown in FIG. 3, the first pane, second pane and the second third pane of the triple glazed window are spaced apart by a distance that is determined by the width of the sash or, where present, the spacer 118. The glazing panes comprise a first glazing pane 111 and a second glazing pane 113, and a third glazing pane 112, the third glazing pane having a durable transparent polymer film 110 attached to surface 6. Double sided tape 114 is used to further seal the second glazing pane to the sash. The first pane and the second pane may be attached to the sealing surfaces of the spacer by one or more additional sealants.

The window may comprise a setting 120 block, a sash frame 122, a glazing stop 124, and panes formed of glass 126.

In some embodiments, the enclosed space can be hermetically sealed from the surrounding atmosphere, and if desired, it can be filled with a gas, such as dry air, or with an inert gas such as argon or nitrogen. In some embodiments, it is useful to provide a desiccant, such as sodium silicate, for example, (not shown in the figures) that is in communication with the enclosed space and is useful to absorb any moisture that may enter the enclosed space in order to avoid or reduce condensation.

The glazing panes that are useful in the present invention can each separately comprise a material selected from the group consisting of glass, fiberglass and plastic. If plastic is used, it can be a polycarbonate, a polyurethane, lexan, Plexiglas, or the like. In some embodiments, it is preferred that the first pane and the second pane each comprise glass. The glass can be annealed glass, tempered glass, or untempered glass. Due to reduced cost, in some embodiments untempered glass is preferred for the glazing panes. The benefits of the present invention of improving impact, blast and shatter resistance are available for both double glazed and triple glazed windows.

The durable transparent polymer film that is useful in the present invention can comprise any polymer, including polyamides, such as nylon; polyolefins such as polypropylene and polyethylene; polyester such as polyethylene terephthalate, polyethylene naphthalate, and polybutylene terephthalate; polyacetal; polycarbonate; copolyesters such as polyethylene terephthalate isophthalate; and the like.

It is preferred that the durable transparent polymer film is at least translucent to visible light and may be transparent. In particular, it is preferred that the polymer film have a percent transmission of visible light of at least about 30%, at least about 40% is more preferred, at least about 50% is yet more preferred, at least about 60% is even more preferred, at least about 70% is yet more preferred, at least about 80% is even more preferred, and a visible light transmission of at least about 82% is yet more preferred.

The polymer film should also be durable. When it is said that the polymer film is durable, it is meant that the polymer is one that has a tensile strength of at least about 15,000 psi, at least about 20,000 psi is more preferred, at least about 25,000 psi is even more preferred, and at least about 30,000 psi is yet more preferred.

It is also preferred that the polymer film is one that has a break strength of at least about 50 lbs/in, and at least about 100 lbs/in is even more preferred, at least about 150 lbs/in is yet more preferred, and at least about 200 lbs/in is even more preferred.

The polymer film can be single thickness, or it can be laminated. Laminated films of this type are described, for example, in U.S. Pat. No. 6,951,595. Films suitable for the present invention are available commercially from Madico, Inc., Woburn, Mass.; 3M, Minneapolis, Minn., and Mitsubishi Polyester Film, LLC, among others.

The durable transparent polymer film of the present invention normally has a uniform thickness, which can be any thickness that is sufficient to provide the features required. Films that are useful in the present invention normally have a thickness within a range of about 0.25 mil to about 50 mil. A thickness from about 5 mil to about 30 mil is preferred, and a thickness of from about 8 mil to about 22 mil is more preferred. Generally, the larger the missile against which protection is desired, the thicker the material to be used.

It may useful for the durable transparent polymer film to be supplied with, or to be prepared to have, a pressure sensitive adhesive on one side that is suitable for adhering the film to the pane. In particular, it is useful for the film to have a pressure sensitive adhesive suitable for forming a tight bond with a clean glass surface. The present polymer film can be provided with a hard coat, such as is described in U.S. Pat. No. 7,101,616, for example, or without such a hard coat.

A preferred durable transparent polymer film is a three layer scratch resistant film having an acrylic adhesive coated on one side thereof for adhering the film to window glazing. The elongation/stretch characteristics of the film may be about 150% machine direction and 100% transverse direction. Tensile strength may be about 36,000 pounds per square inch of each layer. The layers may be formed of polyethylene terephthalate.

In the present window, the first pane 11, 111 and the second pane 12, 113, and if used, the third pane, 112, are spaced apart by a certain distance. The distance between the panes is determined by the distance between the sealing surfaces of the spacer 18,118, plus the thickness of the sealant that is used to adhere the panes to the integral spacer. Although the panes can be spaced apart by any distance that will provide the advantages of the invention, it is preferred that the first pane and the second pane are spaced apart by a distance of from about 6 mm to about 20 mm, a distance of from about 9 mm to about 16 mm is more preferred.

In the present window, the sash can be composed of any material that is conventionally used for the construction of window sashes. In an embodiment of the present window, the sash comprises a material that is selected from one or more of the group consisting of wood, metal and plastic.

It has been found to be particularly useful for the sash to be formed from polymer extrusions. Examples of extruded sash material are shown in U.S. Pat. Nos. 5,622,017 and 6,286,288, among others. Various types of extruded window and door sash material are available from Chelsea Building Products, Oakmont, Pa., and other manufacturers.

Extruded sashes can be produced from any polymer, copolymer, or polymer blend that is suitable to provide the advantages of the invention. The polymer can be filled or unfilled. Examples of materials that are suitable for the production of polymer sash extrusions include polyvinyl chloride, polycarbonate, polyvinyl, and Extrudable Thermal Plastics available from Geon division of the B. F. Goodrich Co., as well as the materials described in U.S. Pat. Nos. 4,430,478 and 5,783,620, among others.

When the sash material is a polymer extrusion, it is optional to include a metal stiffener. Such stiffeners are sometimes used when a long sash length is required, or when exceptionally heavy glass must be supported. One or more metal stiffeners can be used in a window sash.

The first pane 11,111 and the second pane 12,113, and if used, the third pane, 112, may be sealed to the sealing surfaces of the spacer 118, by the use of a sealant, although surface 6 will be secured to the sash by double sided tape. The sealant can be any material or device that is used to seal glazing panes to a window sash, and can be selected from glazing tape, silicone sealant, butyl sealant, or a combination of any two or more of these techniques.

The double sided tape may be a glazing tape that may be a polymer tape having pressure sensitive adhesive on both sides. Some glazing tapes are formed from closed cell polyolefin foam with a glass adhesive on one side and a sash/frame adhesive on the other. See, e.g., Glazing Tape VG 100, or VG-300, available from Venture Tape, Rockland, Mass. Glazing tape suitable for use in the present application is also available from Lamatek, Inc., West Deptford, N.J., and Press-On Tape and Gasket Corp., Addison, Ill. The preferred double sided tape is 3M brand VHB 4991, which is a general industrial tape formed of closed cell acrylic foam, having a thickness of 2.3 mm to 3.0 mm, or an equivalent double sided tape, such as double sided acrylic foam tape from HI-BOND TAPES, INC., which may be VST 6200G. It is preferred to apply a primer prior to the mating surfaces when applying the double sided tape to optimize the holding power and achieve the goal of the invention of holding the broken or shattered shatter glass within the film.

While the use of double sided tape as described has been proven to meet the standards of missile tests as described, adhesives without a substrate and having similar properties may be used. The adhesive must be able to bond to the durable polymer film and the sash and hold the film during missile tests identified above, as well as cyclic static air pressure loading testing protocols, with at least the same degree of strength as the double sided tape. Materials such as SikaFlex or butyl adhesives may be useful.

When the present window is assembled, the panes 11, 12 and the sash 16 provide an enclosed space that serves as an insulating feature of the window. In some embodiments, the enclosed space is hermetically sealed from the outside environment, and if desired, the gas in the enclosed space can be dry air, or can be an inert gas, such as argon or nitrogen.

In order to minimize the moisture content of the gas in the enclosed space, a desiccant is optionally provided that is in contact with the enclosed space. The desiccant can be placed into an aperture of an extruded sash, if desired, so that it communicates with the gas in the enclosed space.

The present invention encompasses a method of making a double glazed or triple glazed impact resistant window. The method comprises forming a window sash that delineates a mounting space for mounting a first pane and a second pane opposite and parallel to and spaced apart from each other. Optionally, a third pane may be mounted in a similar manner. The mounting space is typically formed by constructing a frame of sash members, often pieces cut to length from a long extrusion or molding, as described above, where the frame encloses a space that is slightly larger than and approximately the same shape as the pane that is to be mounted therein. The mounting space is bounded on each side by the sash 16 and on the surface to which the pane is to be mounted. The mounting space may be sized so that the pane will fit therein without touching any side of the mounting space, but will rest on all parts of the respective sealing surface.

At an appropriate time during the fabrication process, the durable transparent polymer film 10 is adhered to surface 4 of the second pane 12. Similarly, the durable transparent polymer film 110 may be adhered to surface 6 of the triple glazed window. The film can be adhered to a large piece of glass, and then the panes, with film attached, can be cut from the larger sheet to conform to the size and shape of the mounting space, or alternatively, the film can be adhered to the pane after the larger sheet has been cut to conform to a suitable size. The film may be attached to other surfaces, such as surfaces 2 and/or 3 of the double glazed window, and surfaces 2, 3, 4, and/or 5 of the single glazed window.

The polymer film is commonly adhered to the pane by the use of a pressure sensitive adhesive that coats one side of the film and adheres tightly to the pane. When the film is obtained from a supplier, it optionally already has the adhesive applied to one side of the film, and provides a protective film, often silicone, over the adhesive. The protective film can be removed and the film can be adhered to the pane.

When the panes are glass, it is preferred that the glass is very clean before the durable transparent polymer film is attached. Any small particle that is present on the glass when the film is applied will remain in the assembly forever, and can have a negative effect on the strength of adherence of the film to the glass (which may negatively affect the impact resistance of the window) and on the visual quality of the window. Accordingly, it is preferred that the glass is thoroughly cleaned prior to applying the film and that the assembly of the film to the glass be carried out in a clean atmosphere.

In some embodiments, excess durable transparent polymer film may be present around the edges of the pane after the durable transparent polymer film has been adhered. In these embodiments, the method further includes trimming the excess durable transparent polymer film prior to the mounting step. The trimming can be done by any method known in the art. For example, in some embodiments, the trimming may be done with a blade, such as a knife or box cutter. In other embodiments, the trimming may be done with a laser.

In further embodiments where the method includes trimming, the trimming of the excess durable transparent polymer film may be done such that the durable transparent polymer film edge is flush with the edge of either glass pane. In other embodiments where trimming is utilized, an amount of durable transparent polymer film may remain over the edge of the glass pane. In further embodiments where trimming is utilized, the trimming of the durable transparent polymer film may be done such that the film no longer covers the entire glass pane. It is preferred that the durable transparent polymer film cover the entire glass pane of surface 4, so that the durable transparent polymer film is properly bonded to the frame or sash, such as shown in FIG. 2, by the double sided tape or other adhesive.

If trimming of the durable transparent polymer film is utilized, it may be done at any stage of the presently claimed method. In some embodiments, the trimming may be done before the protective layer is provided. In other embodiments, the trimming may be done after the protective layer is provided. In other embodiments, the trimming may be done before mounting the pane in the mounting space. In further embodiments, the trimming may be done after mounting the pane in the mounting space.

When film-coated panes of the proper size are prepared, the second pane is mounted in the mounting space with the film covered surface 4 of the pane 12 directly adjacent the sash 16, which is adjacent to the interior of the building. FIG. 2. The film 114 is similarly applied as shown in FIG. 3.

In some embodiments it is preferred to use glazing tape as the sealant in order to prevent or minimize the amount of "squeeze up" of the sealant into the viewing area of the mounting space. Because the enclosed space is essentially sealed as soon as both panes are mounted in the sash, any sealant that is squeezed up between the pane and the sealing surface into the viewing area of the mounting space cannot be removed. However, the use of glazing tape substantially prevents such squeeze up, but provides a strong and durable bond between the pane and the sash. When glazing tape is used as the sealant, the step of mounting the pane in the sash involves adhering glazing tape to the sealing surface of the mounting space and contacting each pane with the tape so that the film-covered surface of the pane is facing the tape. In some embodiments, it is useful to supplement glazing tape with a deformable type sealant, such as a silicone sealant, in order to improve the integrity of the seal.

Figure 1:
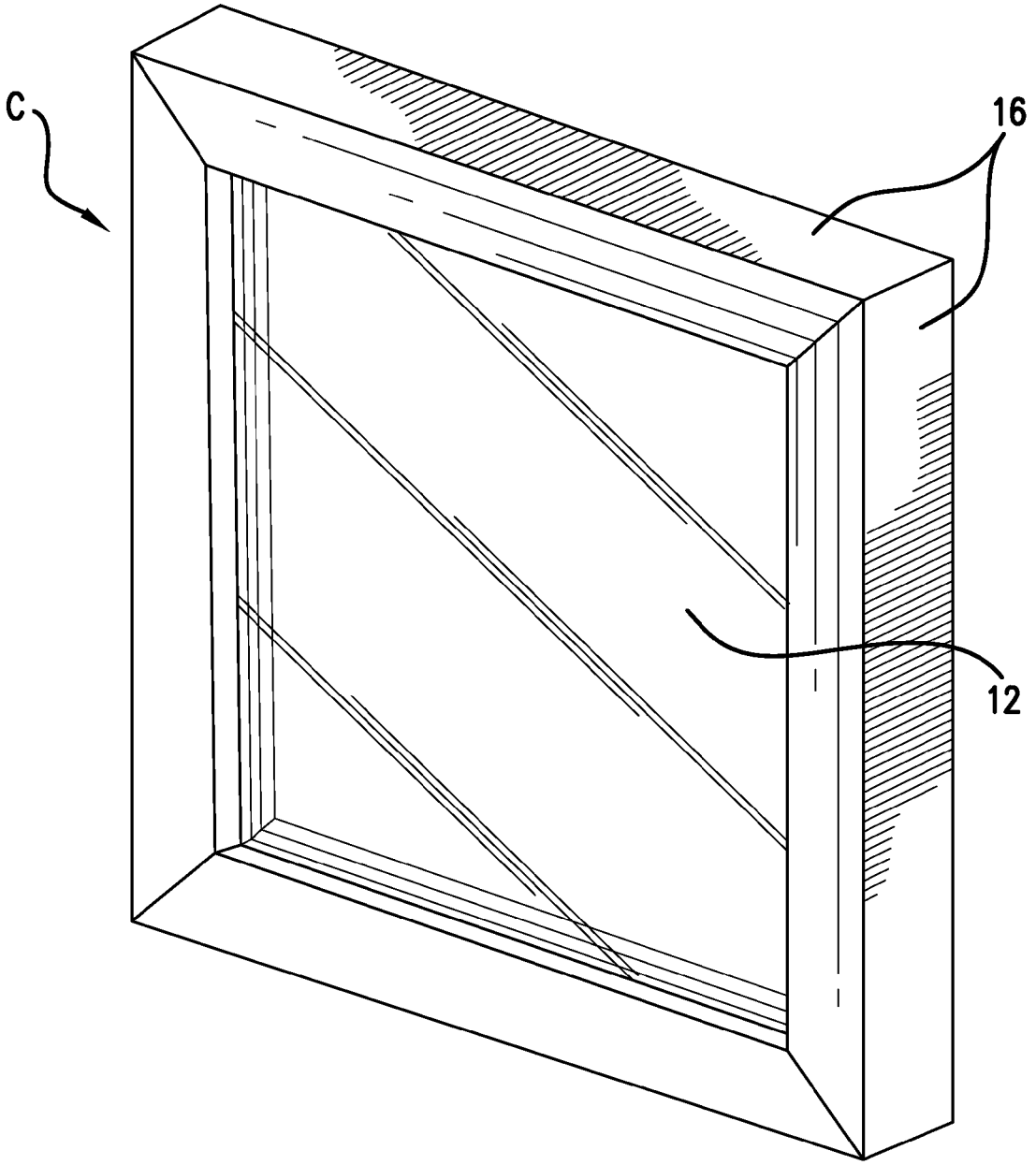
FIG. 1 shows a perspective view (C) of an embodiment of an impact resistant multipane window, such as a double glazed or triple glazed window, according to the present invention.

A typical embodiment of a window of the present invention is shown in FIG. 1, where (C) shows a perspective view of a window having sashes 16 that have been assembled to form a frame that defines a mounting space, into which panes 11, 12 are mounted to form an impact resistant multipane window.

The impact resistant multipane windows of the present invention can be mounted and used in any application in which conventional impact resistant and/or multipane windows are used. Commonly, the novel windows can be mounted in frames in structures such as residential or commercial buildings to serve as strong, energy conserving windows. The novel windows can be components of doors, panels, skylights, and any other similar application. Mounting and use of the present windows is similar to the methods that are well known and are used for conventional impact resistant and/or multipane windows.

Other embodiments within the scope of the claims herein will be apparent to one skilled in the art from consideration of the specification or practice of the invention as disclosed herein. It is intended that the specification be considered to be exemplary only, with the scope and spirit of the invention being indicated by the claims.

All references cited in this specification, including without limitation all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinency of the cited references.

In view of the above, it will be seen that the several advantages of the invention are achieved and other advantageous results obtained.

As various changes could be made in the above methods and compositions by those of ordinary skill in the art without departing from the scope of the invention, it is intended that all matter contained in the above description and shown in the accompanying drawings shall be interpreted as illustrative and not in a limiting sense. In addition it should be understood that aspects of the various embodiments may be interchanged both in whole or in part.

What is claimed is:

1. An impact and blast resistant window, comprising:

a window sash having an opening therein for receiving a window pane;

a window pane positioned in the opening of the window sash;

a durable polymer film coated or adhered to a surface of the window pane, with the durable polymer film positioned on a surface of the window pane that is directly adjacent to an interior of a building in which the window sash is mounted;

wherein the window pane and the durable polymer film are secured to the window sash by adhering one adhesive side of a double sided tape to said window sash and an opposite adhesive side of said double sided tape to said durable polymer film; and wherein the double sided tape comprises closed-cell foam positioned between the one adhesive side of the double sided tape and the opposite adhesive side of the double sided tape.

2. An impact and blast resistant window as described in claim 1, wherein the opposite adhesive side of said double sided tape is adhered to a perimeter of said durable polymer film.

3. An impact and blast resistant window as described in claim 1, wherein the opposite adhesive side of said double sided tape is adhered to an entire perimeter portion of said durable polymer film.

4. An impact and blast resistant window as described in claim 1, wherein the double sided tape is positioned between said durable polymer film and said window sash.

5. An impact and blast resistant window as described in claim 1, wherein the double sided tape is positioned between said polymer film and said window sash, and said double sided tape does not extend beyond a perimeter of said opening in said sash that is covered by said window pane.

6. An impact and blast resistant window as described in claim 1, further comprising a second window pane positioned in the opening of the window sash, wherein the second window pane is spaced apart from said window pane, and said second window pane is adjacent to an exterior of the building in which said window sash in mounted.

7. An impact and blast resistant window as described in claim 6, wherein the window pane and the second window pane are spaced apart by a distance of from about 6 mm to about 20 mm.

8. An impact and blast resistant window as described in claim 1, wherein the window pane comprises glass.

9. An impact and blast resistant window as described in claim 1, wherein the window sash comprises a material that is selected from one or more of the group consisting of wood, metal, vinyl and plastic.

10. An impact and blast resistant window as described in claim 1, wherein the polymer film has a thickness between 7 mils and 25 mils.

11. An impact and blast resistant window as described in claim 1, wherein the one adhesive side of the double sided tape adheres to a sealing surface of a mounting space in the opening of the window sash; and the polymer film-covered surface of the window faces and adheres to the opposite adhesive side of the double sided tape.

12. An impact and blast resistant window as described in claim 1, wherein the durable polymer film comprises a laminated film.

13. An impact and blast resistant window as described in claim 1, wherein the window is a double glazed window.

14. An impact and blast resistant window as described in claim 1, wherein the window is a triple glazed window.

15. An impact and blast resistant window as described in claim 1, wherein said window comprises a plurality of window pane surfaces, and two surfaces of said plurality of window pane surfaces comprise a durable polymer film coated or adhered thereon.

16. An impact and blast resistant window as described in claim 1, wherein the double sided tape comprises an acrylic closed cell foam layer.

17. An impact and blast resistant window as described in claim 1, wherein the double sided tape is 3M VHB Tape 4991.

18. An impact and blast resistant window, comprising:

a window sash having an opening therein for receiving a window pane;

a window pane positioned in the opening of the window sash;

a durable polymer film adhered or coated on a surface of the window pane, with the durable polymer film positioned adjacent to an interior of a building in which the window sash is mounted;

wherein the window pane and the durable polymer film are adhered to the window sash by adhering one adhesive side of a double sided tape to said window sash and an opposite adhesive side of said double sided tape to said durable polymer film;

wherein the double sided tape comprises closed-cell foam positioned between the one adhesive side of the double sided tape and the opposite adhesive side of the double sided tape; and wherein the impact and blast resistant window meets ASTM E1886-02 and ASTM E1996-03 standards.

19. An impact and blast resistant window as described in claim 18, wherein the durable polymer film is adhered to the window sash by the opposite adhesive side of said double sided tape at an entire perimeter portion of said durable polymer film.

20. An impact and blast resistant window as described in claim 18, wherein the durable polymer film is adhered to the window sash at a perimeter of said durable polymer film by the opposite adhesive side of said double sided tape, and wherein the double sided tape is positioned between said durable polymer film and said window sash.

21. An impact and blast resistant window as described in claim 18, wherein the durable polymer film is adhered to the window sash at a perimeter of said durable polymer film by the opposite adhesive side of said double sided tape, and wherein the double sided tape is positioned between said polymer film and said window sash, and said double sided tape does not extend beyond a perimeter of said opening in said sash that is covered by said window pane.

22. An impact and blast resistant window as described in claim 18, wherein the double sided tape comprises an acrylic closed cell foam layer.

23. An impact and blast resistant window as described in claim 18, wherein the double sided tape is 3M VHB Tape 4991.

* * * * *